US006595131B2

(12) United States Patent
Armstrong

(10) Patent No.: US 6,595,131 B2
(45) Date of Patent: Jul. 22, 2003

(54) SHEETING APPARATUS AND METHOD FOR A PRINTING PRESS

(75) Inventor: W. Clifton Armstrong, DeSoto, KS (US)

(73) Assignee: Graphic Technology, Inc., New Century, KS (US)

( * ) Notice: Subject to any disclaimer, the term of this patent is extended or adjusted under 35 U.S.C. 154(b) by 258 days.

(21) Appl. No.: 09/809,515

(22) Filed: Mar. 15, 2001

(65) Prior Publication Data

US 2002/0129721 A1 Sep. 19, 2002

(51) Int. Cl.[7] ..... B41F 13/56

(52) U.S. Cl. ..... 101/226; 101/227; 400/621; 270/5.02

(58) Field of Search ..... 101/224, 226, 101/227; 270/5.02, 5.03, 21.1; 400/621; 83/343, 337, 345, 659, 887

(56) References Cited

U.S. PATENT DOCUMENTS 1,802,554 A * 4/1931 Hahn ..... 83/337
1,975,350 A * 10/1934 Davis ..... 83/345
3,593,659 A * 7/1971 Brackett ..... 101/227
3,869,983 A * 3/1975 Garber et al. ..... 101/227
3,899,946 A * 8/1975 Niepmann ..... 83/426.5
4,014,535 A * 3/1977 Kleid et al. ..... 270/21.1
4,676,159 A * 6/1987 Nawrath ..... 101/226
4,742,741 A * 5/1988 Hallberg et al. ..... 83/337
5,518,329 A * 5/1996 Beaudry ..... 400/621
5,778,782 A * 7/1998 Behringer et al. ..... 101/226
5,806,418 A * 9/1998 Dillinger ..... 101/226
6,026,727 A * 2/2000 Meeks ..... 83/887

* cited by examiner

*Primary Examiner*—Eugene H. Eickholt
(74) *Attorney, Agent, or Firm*—Lathrop & Gage LC

(57) ABSTRACT

A sheeting apparatus and method are disclosed for cutting a web of material passing through a printing press into sheets. The apparatus comprises a rotating die roller including a knife mounted longitudinally thereon, the die roller being connected to the printing press transversely to the web and moveable between an engaging position wherein the knife rotates into cutting engagement with the web and a released position wherein the knife does not contact the web. A pair of springs bias the die roller into one of the engaging and released positions and a pair of linear actuators are provided to selectively move the die roller into the other of the engaging and released positions in opposition to the spring bias. The sheeting apparatus further includes a programmable controller for automatically operating the actuators. The method involves cyclically moving the die roller between the released position and the engaging position at intervals to cut the web into sheets of a predetermined length.

19 Claims, 6 Drawing Sheets

SHEETING APPARATUS AND METHOD FOR A PRINTING PRESS

BACKGROUND OF THE INVENTION

1. Field of the Invention

The invention relates to the field of printing presses, and more specifically to an apparatus and method for cutting a web of print stock passing through a press into sheets of a predetermined length.

2. Description of the Related Art

In the printing industry, printed matter is often applied to a web of material which is fed off of a large roll into a printing press, such as a flexographic press. After the printing is done, the web must be cut into smaller sheets from which the final product will be formed.

Flexographic presses commonly use a rotating "die roller" or "sheeter roller" to perform the cutting step. The die roller is mounted in the press transversely to the web and includes a longitudinally mounted knife which rotates into contact with the web on each revolution of the die roller, cutting the web. Since a cut is made with every revolution of the die roller, the sheets produced by the press will have a length which is equal to the circumference of the die roller. In order to change the length of the sheets, the die roller is removed and a roller with a different circumference substituted in its place.

One problem with a sheeting apparatus as described is that it does not easily lend itself to cutting long sheets such as those required for banners, shelf liners, or edging material. In order to products of this type, the die roller would have to be of a prohibitively large circumference. Such a large roller would be difficult or impossible to mount in the press, would take up an unacceptable amount of space, and would be heavy and hard to handle. Another problem with this system is that changing out the die rollers each time the printer wishes to change sheet size is unnecessarily time consuming and labor intensive.

What is needed is a sheeting apparatus which is more flexible than the prior art system, which allows for the production of sheets of any length, and does not require parts to be interchanged in order to vary the sheet length.

SUMMARY OF THE INVENTION

The present invention comprises a sheeting apparatus for cutting a web of material passing through a printing press into sheets. The apparatus includes a rotating die roller including a knife mounted longitudinally thereon which is oriented transversely to and adjacent one side of the web. The die roller is slidably mounted to the printing press on tracks such that the die roller is moveable between an engaging position wherein the knife rotates into cutting engagement with the web and a released position wherein the knife does not contact the web. A pair of springs are provided which bias the roller into the released position. A pair of linear actuators are selectively operable to move the die roller into the engaging position in opposition to the spring bias. Operation of the actuators is controlled by a programmable controller which extends and retracts the actuators at intervals to produce sheets of a predetermined length. A counter operatively connected to the die roller counts full or partial revolutions of the die roller and transmits a signal to the controller representative of the count. The controller uses the signal to determine the intervals between cycles of the actuators.

DETAILED DESCRIPTION OF THE PREFERRED EMBODIMENT

Figure 1:
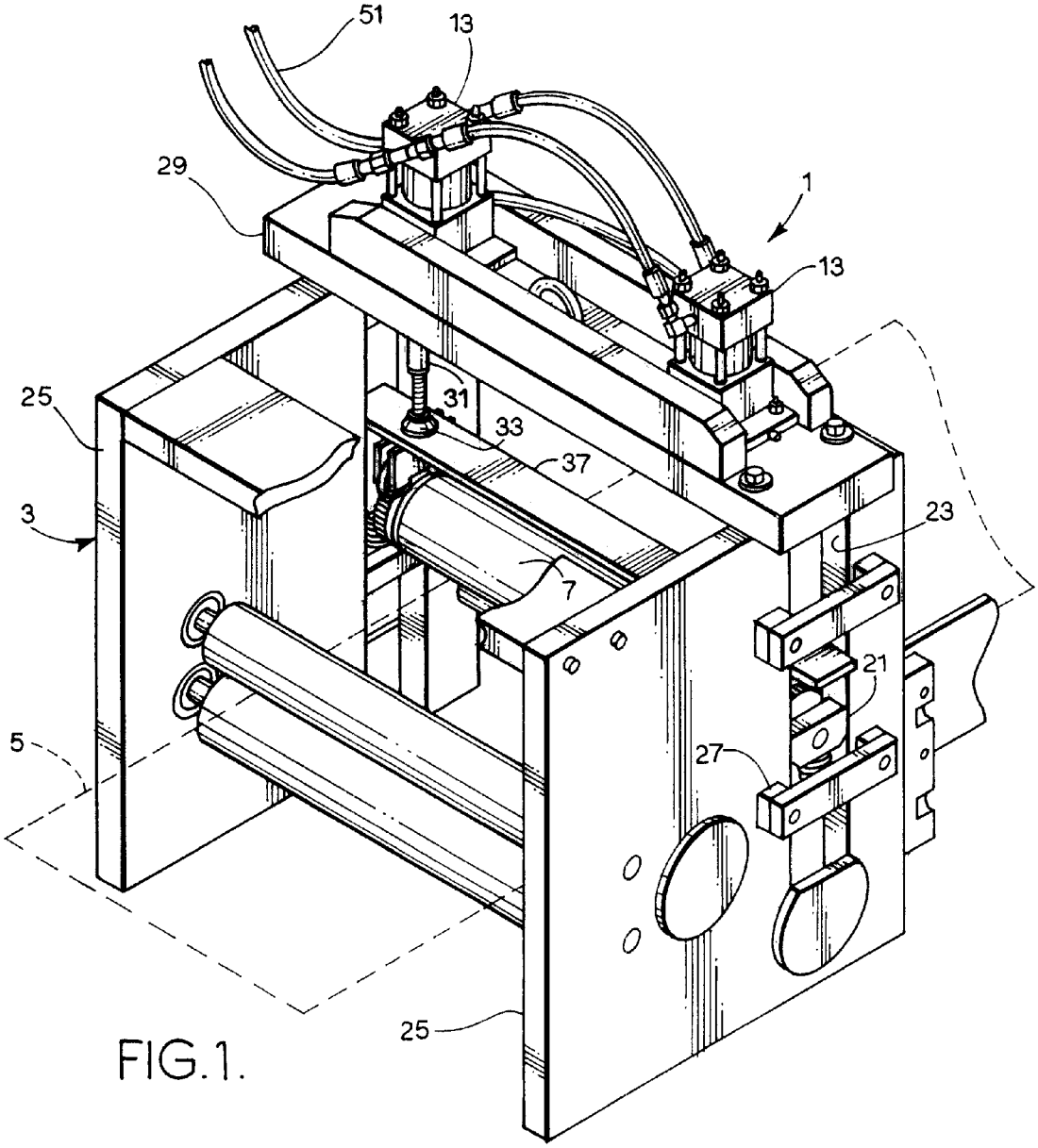
FIG. 1 is a partial perspective view of a flexographic printing press including a sheeting apparatus embodying the present invention.
Figure 2:
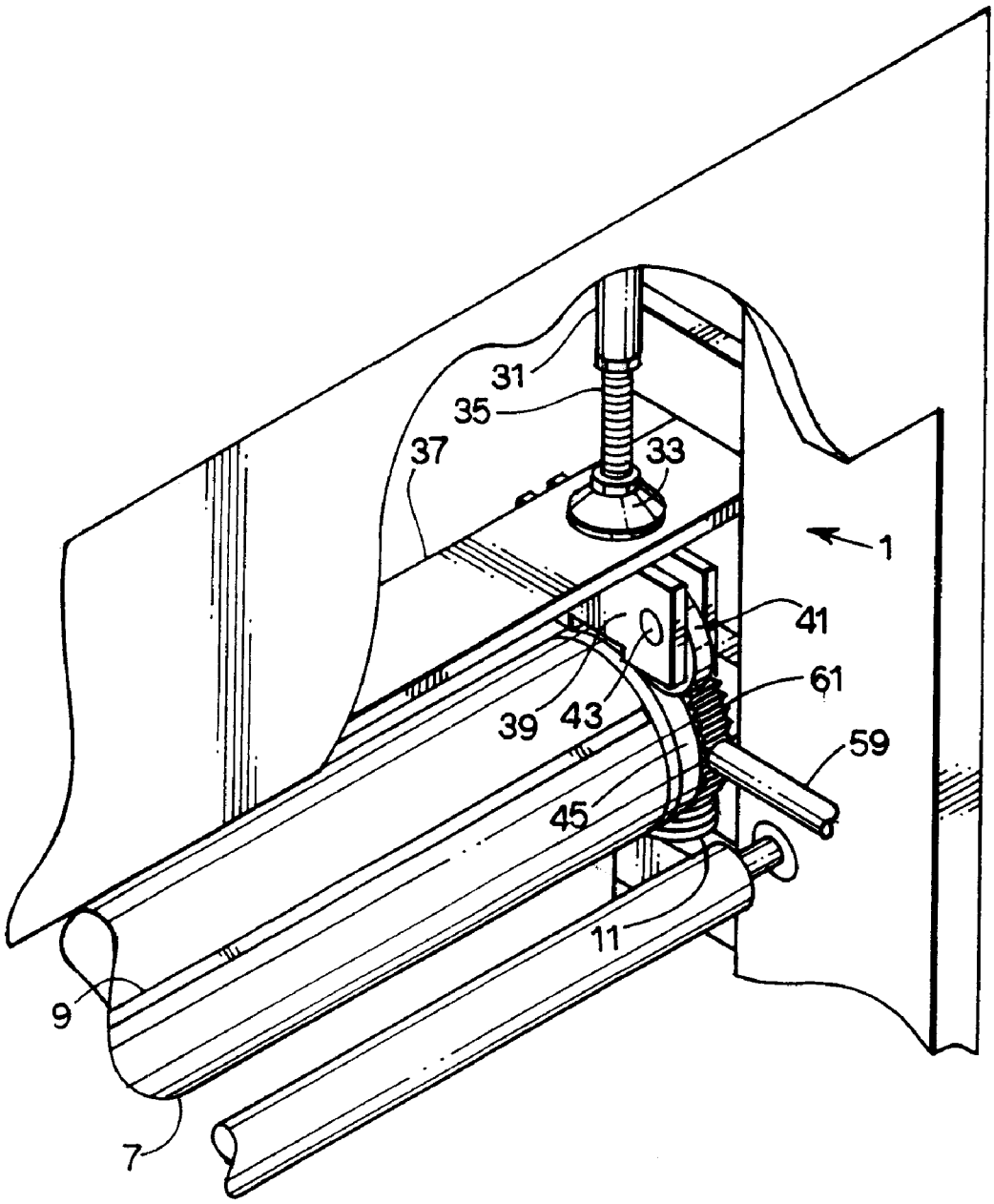
FIG. 2 is a partial, enlarged perspective view of the sheeting apparatus showing one end of the die roller thereof.
Figure 3:
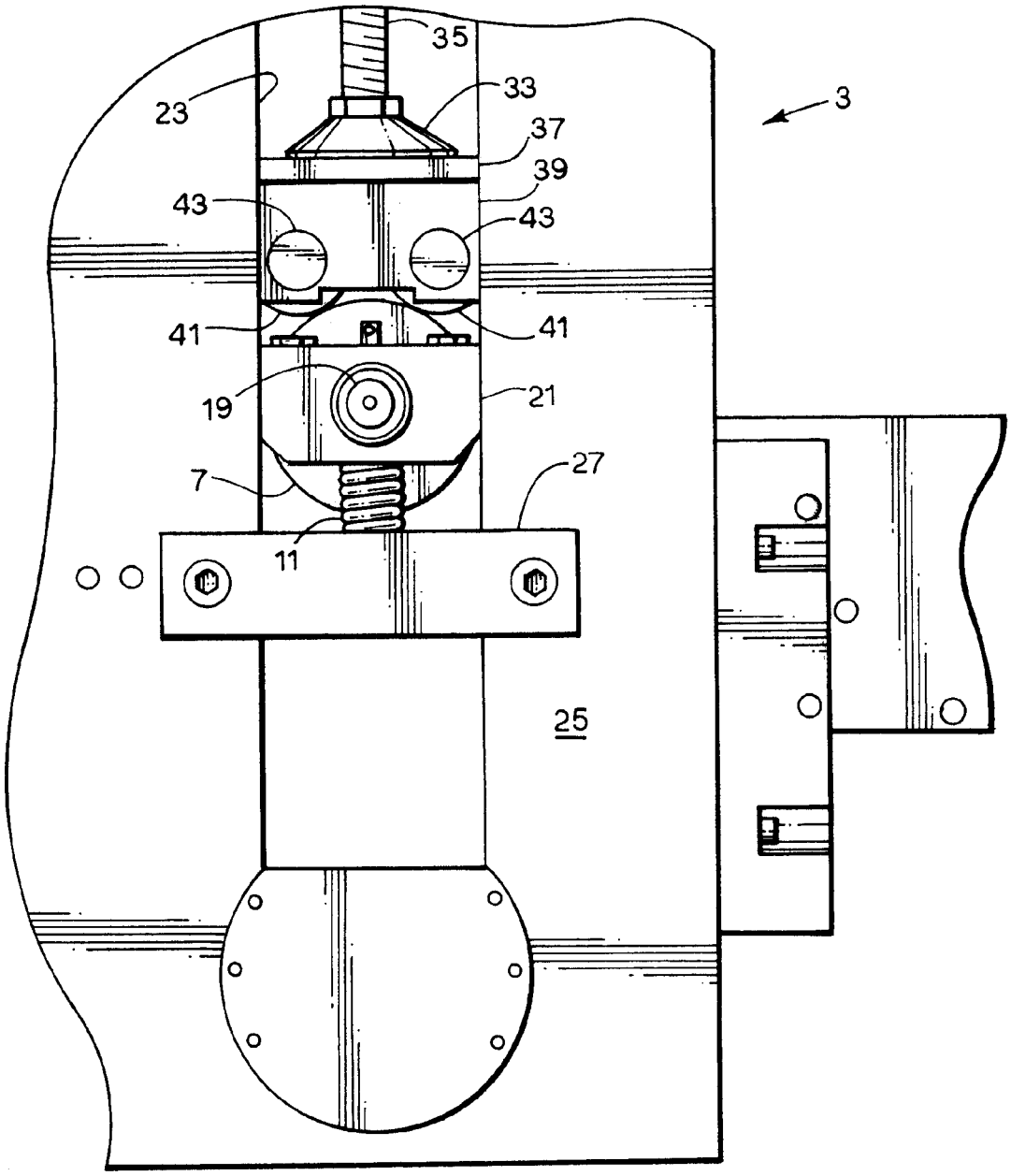
FIG. 3 is a partial side view of the printing press of FIG. 1.
Figure 4:
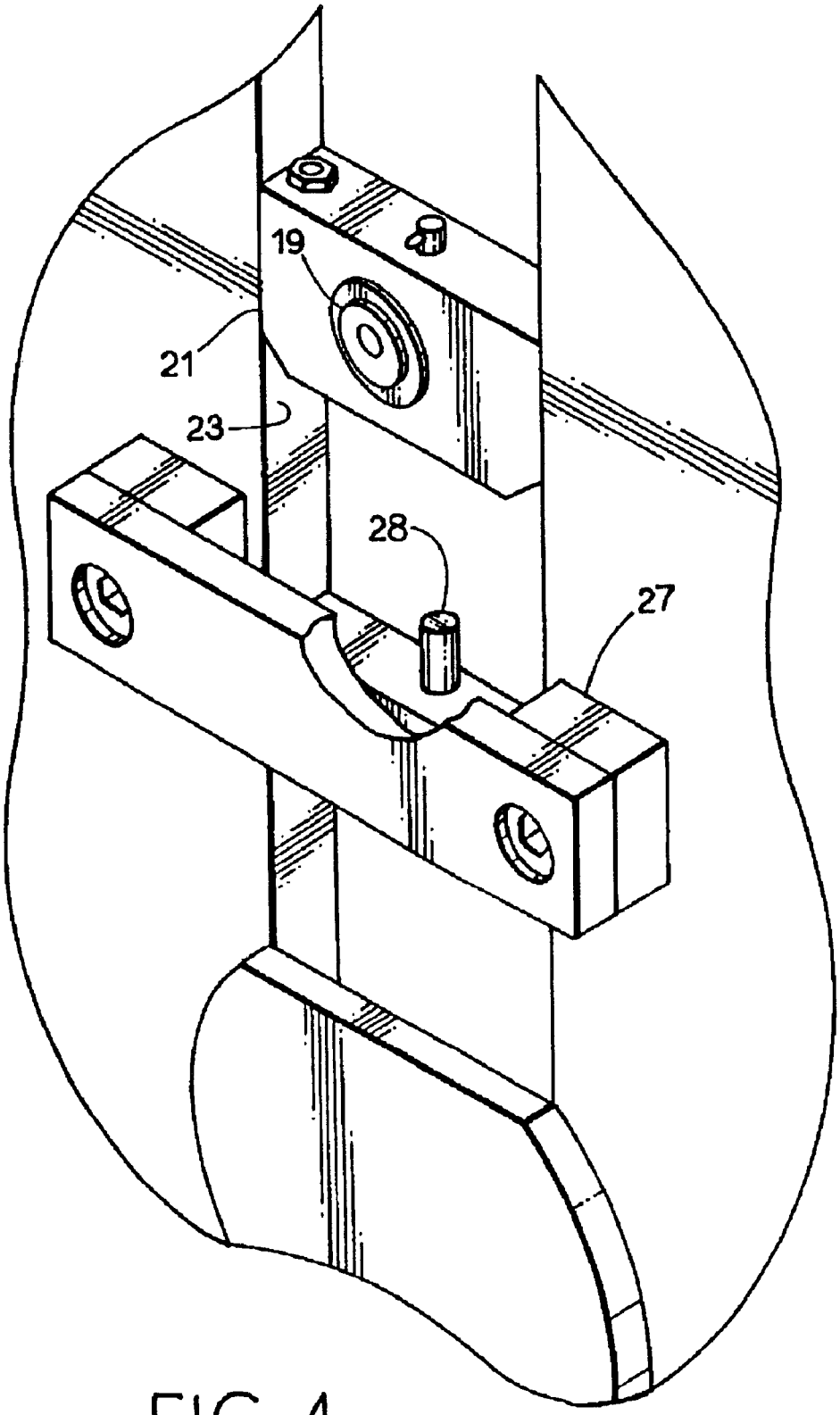
FIG. 4 is a partial enlarged perspective view of the sheeting apparatus showing one of the spring perches with the respective spring removed for clarity.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. The drawings constitute a part of this specification and include exemplary embodiments of the present invention and illustrate various objects and features thereof Certain terminology will be used in the following description for convenience in reference only and will not be limiting. For example, the words "upwardly," "downwardly," "rightwardly," and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

Referring to the drawings in more detail, the reference number 1 generally designates a sheeting apparatus embodying the present invention. The apparatus 1 is for use on a printing press, such as a flexographic press 3 to control the cutting or "sheeting" of a web 5 passing through the press 3. As is common in such presses 3, the cutting of the web 5 is accomplished by means of a rotating die roller or sheeter roller 7 having a single knife 9 longitudinally mounted thereon. However, unlike prior art die rollers which are spaced at a fixed distance from the web 5, the die roller 7 of the apparatus 1 is selectively movable toward or away from the web 5 so that the web 5 may be cut into sheets of any predetermined length.

The apparatus 1 generally comprises a die roller 7 slidably movable relative to the web 5, a pair of springs 11 biasing the die roller 7 away from the web 5, a pair of hydraulic actuators 13 selectively acting in opposition to the springs 11 to push the die roller 7 toward, and into cutting engagement with, the web 5, a hydraulic system 15 for powering the actuators 13, and an electronic control system 17 programmable to move the die roller 7 at the proper intervals to cut the web 5 into sheets of the desired length.

The die roller 7 is rotatably mounted on a shaft 19 which has each end journaled to a respective one of a pair of slider blocks 21. The slider blocks 21 are slidably mounted in tracks 23 formed in opposing side plates 25 of the press 3. The die roller 7 is positioned above the web 5 so as to be moveable along the tracks 23 between a lower or engaging position wherein the die roller 7 is in cutting engagement with the web 5 and an upper or released position wherein the die roller 7 is not in contact with the web 5. The springs 11 are each positioned below a respective one of the slider blocks 21 such that the upper ends of the springs 11 bear against the slider blocks 21. The lower ends of the springs 11 are supported on spring perches 27 connected to the side plates 25. The spring perches each include a locating pin 28 which retains the respective spring 11 in position. Thus positioned, the springs 11 act to urge the die roller 7 upwardly and into the released position.

The hydraulic actuators 13 are mounted above the die roller 7 on a bridge 29 which spans the press 3 parallel to the die roller 7 and is securely fixed to both side plates 25 of the press 3. Each actuator 13 includes a linearly moveable ram 31 which extends downwardly from the bridge 29 toward the die roller 7. Each ram 31 includes an end piece 33 having a jack screw 35 which allows the length of the ram 31 to be adjusted.

The end pieces 33 of the rams 31 each bear against the upper surface of a crosspiece 37 which spans the press 3 parallel to the die roller 7 and bridge 29. Each end of the crosspiece 37 rides in the tracks 23 of the press side plates 25. Extending downwardly from the cross piece 37 proximate each end of the die roller 7 are a pair of clevis plates 39 spaced apart to accommodate a pair of roller bearings 41 therebetween. The roller bearings 41 are rotatably mounted between the clevis plates 39 and connected thereto by axles 43. The roller bearings 41 bear against bearing surfaces 45 of the die roller 7 which are located proximate the ends of the roller 7. The cross piece 37 and attached roller bearings 41 act to transfer downward pressure from the actuators 13 to the die roller 7 while allowing the die roller 7 to rotate freely.

The hydraulic system 15 selectively provides pressurized hydraulic fluid to the actuators 13 in order to push the die roller 7 downwardly. The hydraulic system 15 includes a fluid reservoir (not shown) and a hydraulic pump 49 which circulates the fluid between the reservoir and the actuators 13. The pump 49 is powered by a motor 50. The actuators 13 are connected in parallel to the pump 49 by hydraulic lines 51. Flow between the pump 49 and actuators 13 is controlled by solenoid valves 53 interposed between the pump 49 and actuators 13.

Figure 5:
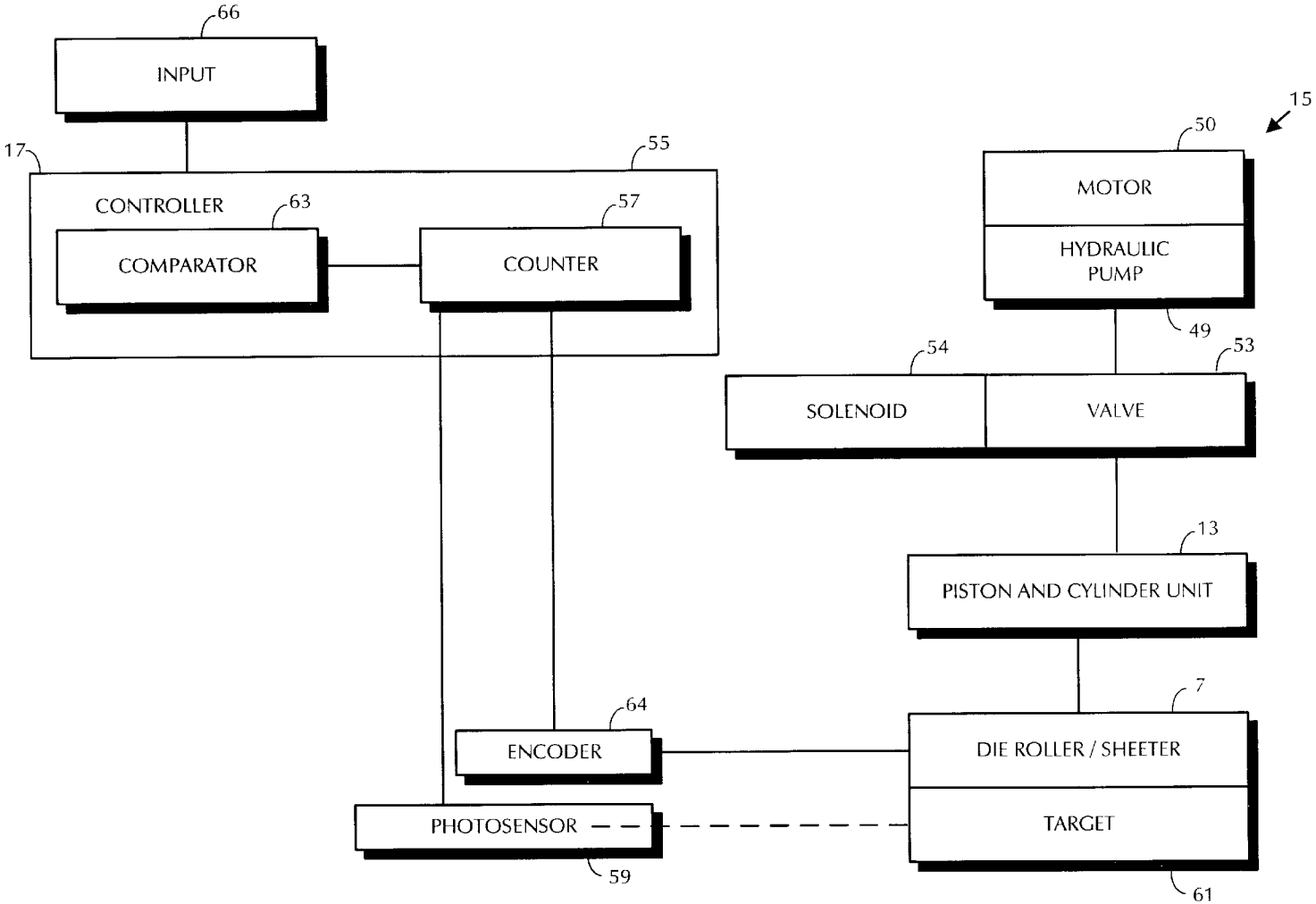
FIG. 5 is a block diagram showing the control system for the sheeting apparatus.

Referring to FIG. 5, he solenoid valves 53 include solenoids 54 which are electrically connected to a programmable controller 55 which is part of the electronic control system 17. The controller 55 is capable of automatically operating the valves 53 to extend the actuators 13 at intervals to produce sheets of a desired length, the desired length having been input into the controller 55 by the press operator. For ease of calculating the length of the sheet, the die roller 7 is preferably driven by the press 3 at a constant speed which is related to the linear speed of the web 5 such that the length of a cut sheet will equal the diameter of the die roller 7 multiplied by the number of revolutions or partial revolutions of the die roller 7 between cuts. The controller 55 can, therefore, determine the proper intervals between extensions of the actuators 13 to produce a sheet of the desired length based solely upon the number of revolutions of the die roller 7. It is foreseen, however, that sheeting apparatuses could be produced which have a die roller 7 driven at a constant speed which is different from that described herein or which have a variable speed control for the die roller 7. Such alternative versions of the apparatus 1 are considered to be within the scope of the present invention.

A counter 57 which includes a photosensor 59 operatively connected to a rotating target 61 on the die roller 7 is provided to count the number of full revolutions of the die roller 7. An encoder 64 is also operatively connected to the die roller 7 and generates a signal representing the angular orientation of the die roller 7 and knife 9. The signal from the encoder 64 is relayed to the counter 57 and is used to determine partial revolutions of the die roller 7. The counter then generates a signal representing the number of full or partial revolutions of the die roller 7 and relays it to a comparator 63 which forms a part of the controller 55. The comparator 63 then compares the revolution count to the desired sheet length divided by the diameter of the die roller 7. When the two values are equal, the controller triggers the solenoid valves 53, extending the actuators 13 and making the cut.

Figure 6:
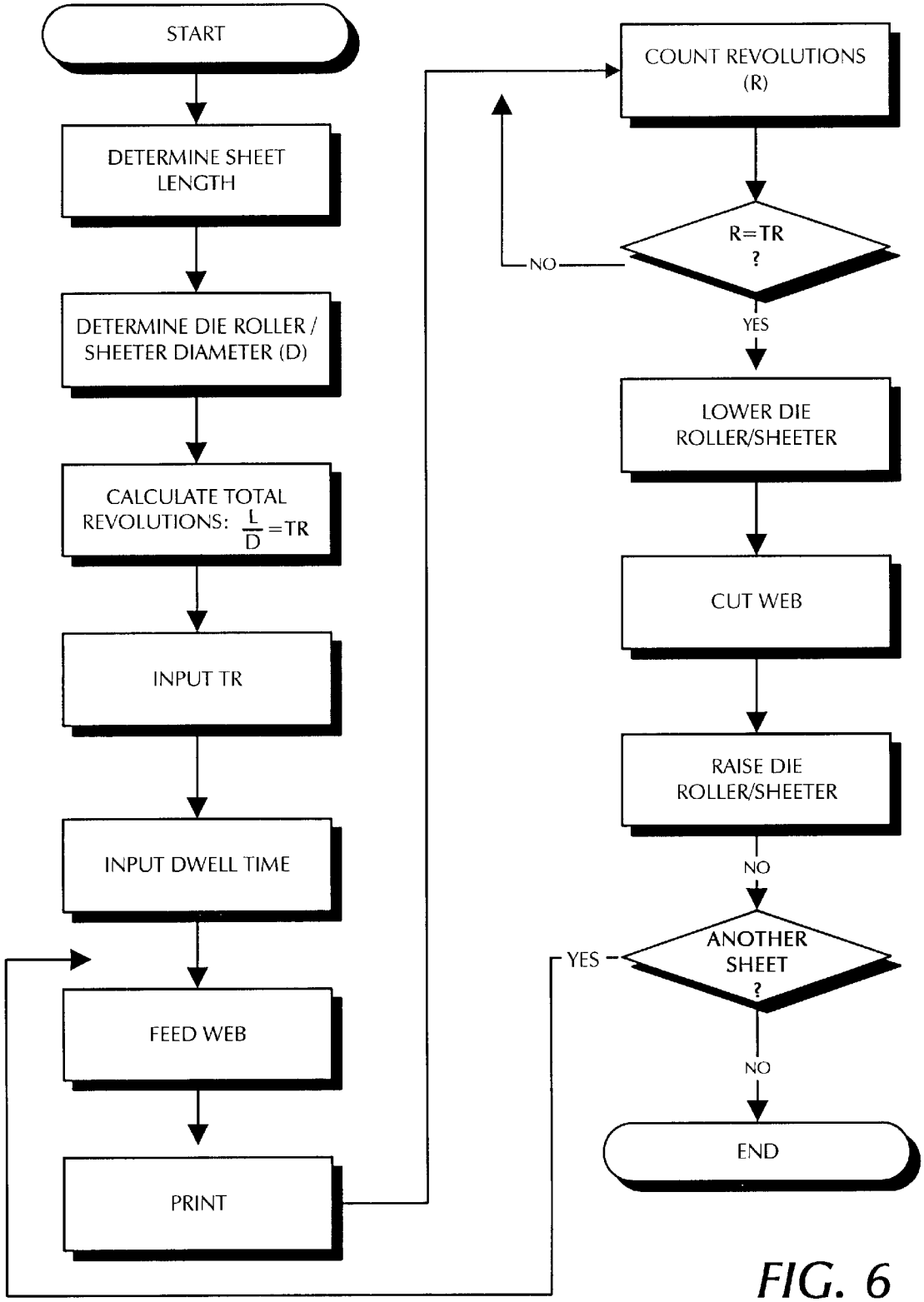
FIG. 6 is a flow chart showing the steps involved in a sheeting method utilizing the sheeting apparatus.

In use, the apparatus 1 serves to cut the web 5 into a plurality of sheets of a predetermined length. The operation of the apparatus 1 is diagramed in FIG. 6. The press operator first determines the desired length (L) of the sheets and the diameter (D) of the die roller 7. FIG. 6. shows the total revolutions (TR) of the die roller 7 between cuts then being calculated by the press operator, who divides the desired sheet length (L) by the die roller diameter (D) to get the total revolutions (TR). The total revolutions (TR) can then be input into the controller 55. Alternatively, the length (L) and diameter (D) could be separately input into the controller 55 which could then automatically calculate the total revolutions (TR).

An amount of dwell, which represents the interval during which the die roller 7 will be held in its engaging position, is also input into the controller 55. The dwell may be expressed either as a time period or in terms of degrees of rotation of the die roller 7 during the dwell period. A typical dwell would be the time required for the die roller 7 to rotate 60 degrees or one sixth of a rotation. Referring to FIG. 5, the total revolutions (TR) (or the desired length (L) and roller diameter (D) required to calculate the total revolutions (TR)) and the dwell collectively form the input 66 for the controller 55.

The web 5 is then fed past the die roller 7 with the die roller 7 raised into its released position. The comparator 63 receives the signal from the counter 57 representing the number of revolutions (R) of the die roller 7 and compares it to the total revolutions (TR) necessary to produce a sheet of the desired length (L). When (R) is equal to (TR) the controller 55 causes the actuators 13 to extend, lowering the die roller 7 into its engaging position and cutting the web 5. The die roller 7 stays in the engaging position for the dwell period and is then raised back into the released position by the controller 55. If another sheet is desired, the counting and comparison process is repeated and another cut made.

It is to be understood that while certain forms of the present invention have been illustrated and described herein, it is not to be limited to the specific forms or arrangement of parts described and shown. For example, while the actuators 13 have been described herein as being hydraulically operated, actuators operated pneumatically, electromechanically, or by other similar means could be substituted for the hydraulic actuators without changing the general nature of the invention, and such devices are considered to be within the scope of the present invention. It is also foreseen that the relative positions of the springs and actuators of the present invention could be reversed, such that the springs urge the die roller toward the web and the actuators push the die roller away from the web in opposition to the springs. Expansion springs, air springs, or other spring means could easily be substituted for the coil compression springs depicted herein. Furthermore, while the web has been described and depicted herein as running generally horizontally with the die roller disposed above the web, this orientation is not intended to be limiting. The die roller could be positioned below the web, or the web could move vertically or in some other direction past the die roller. All that is required is that the die roller be selectively movable toward and away from the web.

What is claimed and desired to be secured by Letters Patent is as follows:

1. A sheeting apparatus for cutting a web of material passing through a printing press into sheets, said apparatus comprising:

a) a rotating die roller having a knife mounted longitudinally thereon, said die roller being connected to the printing press transversely to the web and moveable between an engaging position wherein said knife rotates into cutting engagement with the web and a released position wherein said knife does not contact the web;

b) a spring biasing said die roller into one of said engaging and released positions;

c) a linear actuator selectively operable to move said die roller into the other of said engaging and released positions in opposition to said spring bias; and d) a programmable controller capable of operating said actuator at intervals to produce sheets of a predetermined length.

2. The sheeting apparatus as in claim 1 and further comprising a counter operatively connected to said die roller and counting full or partial revolutions thereof and transmitting a signal to said controller representative of said count, said controller using said signal to determine said intervals.

3. The sheeting apparatus as in claim 1 wherein the web runs generally horizontally through the press and said die roller is positioned above the web.

4. The sheeting apparatus as in claim 3 wherein the press includes opposing side plates and said apparatus further includes:

a) a pair of generally vertical tracks, each track in said pair located on a respective side plate of the printing press; and b) a pair of slider blocks, each slider block in said pair slidably mounted in a respective one of said tracks, said die roller being rotatably journaled at each end thereof to a respective one of said slider blocks.

5. The sheeting apparatus as in claim 4 wherein:

a) said spring is a first spring and said apparatus further includes a second spring;

b) said apparatus further includes a pair of spring perches, each spring perch in said pair being connected to a respective press side plate below the respective slider block; and c) each of said first and second springs is mounted between a respective one of said slider blocks and the respective spring perch, said springs biasing said slider blocks and said die roller upwardly away from the web.

6. The sheeting apparatus as in claim 5 wherein:

a) said linear actuator is a first linear actuator and said apparatus further includes a second linear actuator, each of said first and second linear actuators having a respective ram;

b) said apparatus further includes a bridge fixedly secured to the press side plates and spanning the web parallel to and spaced above said die roller; and c) said first and second linear actuators are mounted on said bridge, each said ram selectively acting on said die roller proximate a respective end thereof to push said die roller downwardly toward the web in opposition to said first and second springs.

7. The sheeting apparatus as in claim 6 wherein said linear actuators act on said die roller through a linkage comprising:

a) a crosspiece spanning the web intermediate said bridge and said die roller and oriented generally parallel thereto, said crosspiece having top and bottom surfaces and opposing ends, each said crosspiece end riding in a respective one of said tracks, each of said rams engaging said upper surface of said crosspiece proximate a respective one of said crosspiece ends;

b) two pairs of clevis plates mounted to said crosspiece lower surface, one said pair of clevis plates proximate each said crosspiece end, the clevis plates in each said pair of clevis plates being oriented transversely to said die roller and in spaced apart relation to each other; and c) two pairs of roller bearings, each said pair of roller bearings being rotatably mounted between a respective pair of said clevis plates, each roller bearing in each said pair of roller bearings rotatable about separate spaced apart axes, each said pair of roller bearings rollingly engaging said die roller proximate a respective end thereof.

8. A sheeting apparatus for cutting a web of material passing through a printing press into sheets, said apparatus comprising:

a) a pair of tracks connected to the press, the tracks in said pair being located on opposing sides of the web;

b) a pair of slider blocks, each slider block in said pair being slidably mounted in a respective one of said tracks;

c) a rotating die roller having a knife mounted longitudinally thereon, said die roller having opposing ends, each of said ends being rotatably journaled to a respective one of said slider blocks, said die roller moveable along said tracks toward and away from the web;

d) a pair of springs, each spring in said pair engaging a respective one of said slider blocks and biasing said respective slider block away from the web; and e) a linear actuator connected to the printing press and selectively operable to move said die roller toward the web in opposition to said spring bias into an engaging position wherein said knife rotates into cutting engagement with the web.

9. The sheeting apparatus as in claim 8 wherein said actuator acts on said die roller through a linkage comprising:

a) a crosspiece spanning the web generally parallel to said die roller, said crosspiece having first and second surfaces and opposing ends, each said crosspiece end riding in a respective one of said tracks, said linear actuator engaging said first surface of said crosspiece; and b) a pair of roller bearings rotatably mounted to said second surface of said crosspiece and rollingly engaging said die roller.

10. The sheeting apparatus as in claim 8 and further comprising a programmable controller capable of operating said actuator at intervals to produce sheets of a predetermined length.

11. The sheeting apparatus as in claim 10 and further comprising a counter operatively connected to said die roller and counting full or partial revolutions thereof and transmitting a signal to said controller representative of said count, said controller using said signal to determine said intervals.

12. The sheeting apparatus as in claim 10 wherein the web runs generally horizontally through the press and said die roller is positioned above the web.

13. A sheeting apparatus for cutting a web of material passing through a printing press into sheets, said apparatus comprising:

a) a rotating die roller having a knife mounted longitudinally thereon, said die roller oriented transversely to the web;

b) means for mounting said die roller to the printing press such that said die roller is moveable between an engaging position wherein said knife rotates into cutting engagement with the web and a released position wherein said knife does not contact the web, wherein said means for mounting comprises a pair of tracks connected to the printing press, and a pair of slider blocks, each slider block in said pair slidably mounted in a respective one of said tracks, said die roller being rotatably journaled at each end thereof to a respective one of said slider blocks; and c) means for selectively moving said die roller between said engaging position and said released position.

14. The sheeting apparatus as in claim 13 wherein said means for selectively moving comprise:

a) a spring biasing said roller into said released position;

b) a linear actuator selectively operable to move said rotating die roller into said engaging position in opposition to said spring bias; and c) a programmable controller capable of operating said actuator at intervals to produce sheets of a predetermined length.

15. The sheeting apparatus as in claim 14 wherein said means for selectively moving further include a counter operatively connected to said die roller and counting full or partial revolutions thereof and transmitting a signal to said controller representative of said count, said controller using said signal to determine said intervals.

16. A method of sheeting a web passing through a printing press comprising the steps of:

a) providing the printing press with a rotating die roller having a knife mounted longitudinally thereon, said roller being connected to the printing press transversely to the web and moveable between an engaging position wherein said knife rotates into cutting engagement with the web and a released position wherein said knife does not contact the web; and b) cyclically moving said die roller between said released position and said engaging position at intervals to cut the web into sheets of a predetermined length.

17. The method as in claim 16 and further comprising the steps of:

a) counting full or partial revolutions of said die roller; and b) using said count to determine said intervals.

18. A method of sheeting a web passing through a printing press at a constant linear speed comprising the steps of:

a) providing the printing press with a rotating die roller having a knife mounted longitudinally thereon, said roller being connected to the printing press transversely to the web and moveable between an engaging position wherein said knife rotates into cutting engagement with the web and a released position wherein said knife does not contact the web;

b) rotating said die roller at a constant speed which is related to said constant linear speed of the web such that the actual sheet length will equal the diameter of the die roller multiplied by the number of revolutions of the die roller between cuts;

c) providing a programmable controller operatively connected to said die roller to automatically move said die roller between said engaging and released positions;

d) providing a counter operatively connected to said die roller to count actual revolutions thereof and generate a signal representative of said count and transmit said signal to said controller;

e) determining a desired length for said sheets;

f) determining the diameter of said die roller;

g) dividing said desired length by said diameter to obtain a quotient representing the desired number of revolutions of said die roller between cuts;

h) said controller comparing said count of actual revolutions of said die roller to said desired number of total revolutions; and i) said controller moving said die roller into said engaging position when the count of actual revolutions of the die roller is equal to the desired total revolutions, and thereby cutting said web.

19. The method as in claim 18 and further including the steps of:

a) inputting a dwell period during which said die roller will remain in said engaged position; and b) said controller moving said die roller into said released position after said dwell period has elapsed.

* * * * *